US010204773B2

(12) United States Patent
Sugiyama et al.

(10) Patent No.: US 10,204,773 B2
(45) Date of Patent: Feb. 12, 2019

(54) ION GUIDE AND MASS SPECTROMETER USING SAME

(71) Applicant: HITACHI HIGH-TECHNOLOGIES CORPORATION, Tokyo (JP)

(72) Inventors: Masuyuki Sugiyama, Tokyo (JP); Hideki Hasegawa, Tokyo (JP); Masao Suga, Tokyo (JP); Hiroyuki Satake, Tokyo (JP); Yuichiro Hashimoto, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 15/549,228

(22) PCT Filed: Feb. 23, 2015

(86) PCT No.: PCT/JP2015/054950
§ 371 (c)(1),
(2) Date: Aug. 7, 2017

(87) PCT Pub. No.: WO2016/135810
PCT Pub. Date: Sep. 1, 2016

(65) Prior Publication Data

US 2018/0025896 A1 Jan. 25, 2018

(51) Int. Cl.
*H01J 49/00* (2006.01)
*H01J 49/06* (2006.01)
*H01J 49/42* (2006.01)

(52) U.S. Cl.
CPC ..... *H01J 49/063* (2013.01); *H01J 49/42* (2013.01)

(58) Field of Classification Search
CPC ..... H01J 49/062; H01J 49/063; H01J 49/065; H01J 49/26; H01J 49/42
See application file for complete search history.

(56) References Cited

U.S. PATENT DOCUMENTS 6,417,511 B1 * 7/2002 Russ, IV ..... H01J 49/063 250/292
6,979,816 B2 * 12/2005 Tang ..... H01J 49/066 250/288

(Continued)

FOREIGN PATENT DOCUMENTS

JP 2004-515882 A 5/2004
JP 2010-541125 A 12/2010

(Continued)

OTHER PUBLICATIONS

International Search Report of PCT/JP2015/054950 dated May 19, 2015.

*Primary Examiner* — Wyatt Stoffa
(74) *Attorney, Agent, or Firm* — Mattingly & Malur, PC

(57) ABSTRACT

A first rod electrode set has a first center axis, into which ions and air current are introduced. A second rod electrode set has a second center axis at a distance from the first center axis, from which the ions are discharged. A power supply applies voltages to the first rod electrode set and the second rod electrode set. The first rod electrode set and the second rod electrode set have a region where the sets overlap each other in the longitudinal direction, and form a single multipole ion guide by being combined to each other in the region. Different offset DC voltages are applied to the first rod electrode set and the second rod electrode set, respectively, and a DC potential for moving the ions to the second rod electrode set in the region is formed, the ions having been guided by the first rod electrode set.

18 Claims, 17 Drawing Sheets

(56) References Cited

U.S. PATENT DOCUMENTS

| | | | | |
|---|---|---|---|---|
| 7,196,326 | B2 * | 3/2007 | Franzen | H01J 49/0077 250/288 |
| 7,256,395 | B2 | 8/2007 | Collings et al. | |
| 7,718,959 | B2 * | 5/2010 | Franzen | H01J 49/4225 250/281 |
| 7,952,070 | B2 * | 5/2011 | Senko | H01J 49/063 250/281 |
| 8,581,182 | B2 | 11/2013 | Giles | |
| 9,190,256 | B2 * | 11/2015 | Brown | H01J 49/164 |
| 9,305,758 | B2 * | 4/2016 | Kalinitchenko | H01J 49/067 |
| 2003/0155496 | A1 * | 8/2003 | Kalinitchenko | H01J 49/061 250/281 |
| 2007/0057178 | A1 * | 3/2007 | Chernushevich | H01J 49/063 250/288 |
| 2008/0048113 | A1 * | 2/2008 | Franzen | H01J 49/4225 250/292 |
| 2010/0176295 | A1 * | 7/2010 | Senko | H01J 49/063 250/292 |
| 2011/0049357 | A1 * | 3/2011 | Giles | H01J 49/062 250/283 |
| 2013/0240726 | A1 * | 9/2013 | Hasegawa | H01J 49/063 250/288 |
| 2014/0191123 | A1 * | 7/2014 | Wildgoose | H01J 49/061 250/282 |
| 2015/0206731 | A1 * | 7/2015 | Zhang | H01J 49/065 250/396 R |

FOREIGN PATENT DOCUMENTS

| | | | |
|---|---|---|---|
| JP | 2014-521189 | A | 8/2014 |
| WO | 01/091159 | A1 | 11/2001 |
| WO | 2009/037483 | A2 | 3/2009 |
| WO | 2013/005058 | A1 | 1/2013 |

* cited by examiner (A)

(B)

(A)

(B)

(A)

(B)

(A)

(B)

ION GUIDE AND MASS SPECTROMETER USING SAME

TECHNICAL FIELD

The present invention relates to an ion guide and a mass spectrometer using the same.

BACKGROUND ART

An ion guide is widely used in transporting ions in a mass spectrometer. In PTL 1, a multipole ion guide configured of parallel rod electrodes of a multipole (quadrupole, hexapole, octupole, or the like), is disclosed. In PTL 2, an ion guide in which ions move between the ion guides by climbing over a pseudopotential barrier between two ion guides by a DC potential, is disclosed. In PTL 3, an ion guide which forms one multipole ion guide by combining two independent multipole ion guides, is disclosed.

CITATION LIST

Patent Literature

PTL 1: U.S. Pat. No. 7,256,395 B2
PTL 2: U.S. Pat. No. 8,581,182 B2
PTL 3: US 2010/0176295 A1

SUMMARY OF INVENTION

Technical Problem

In the ion guide described in PTL 1, since air current and the center of a pseudopotential of the ion guide are substantially coaxially incident to each other, there is a problem that the ion and the air current cannot be separated from each other.

In the ion guide of PTL 2, the pseudopotential barrier exists between axes of two ion guides. Therefore, in moving the ions from one ion guide to the other ion guide, it is necessary to apply a DC electric field which is sufficiently higher than the pseudopotential barrier. However, a kinetic energy of ions after climbing over the pseudopotential barrier when applying a high DC electric field increases, and ions are discharged to the outside of the ion guide. Therefore, there is a problem that a transmission efficiency of the ion guide is low. In addition, the method of PTL 2 can be employed in a high-order multipole ion guide or a ring stack type ion guide, but it is difficult to employ the method in a multipole having a low order, such as quadrupole. Therefore, when comparing with the multipole ion guide having a low order, such as the quadrupole ion guide, there is also a problem that performance of converging the ions is low.

In PTL 3, an operation under the condition that the air current exists is not described. In addition, in PTL 3, it is not described that the DC voltage which is different from that of another rod electrode is applied to a rod of a part of the rod electrode that configures the ion guide, and there is a problem that the ions are distributed in the vicinity of a minimum point of the pseudopotential.

The present invention realizes an ion guide which can separate air current and ions from each other, and which has high ion transmission efficiency.

Solution to Problem

According to the present invention, there is provided an ion guide including: a first rod electrode set which has a first center axis, and into which ions and air current are introduced; a second rod electrode set which has a second center axis at a distance from the first center axis, and from which the ions are discharged; and a power supply that applies voltages to the first rod electrode set and the second rod electrode set, in which the first rod electrode set and the second rod electrode set have a region where the sets overlap each other in the longitudinal direction, and form a single multipole ion guide by being combined to each other in the region where the sets overlap each other, in which different offset DC voltages are applied to the first rod electrode set and the second rod electrode set, respectively, from the power supply, and in which the offset DC voltage forms a DC potential for moving the ions to the second rod electrode set in the region where the sets overlap each other, the ions having been guided by the first rod electrode set.

According to one aspect of the present invention, the first rod electrode set and the second rod electrode set are quadrupoles, and the single multipole ion guide is a hexapole.

In addition, according to another aspect of the present invention, the first rod electrode set and the second rod electrode set are quadrupoles, and the single multipole ion guide is an octupole.

Advantageous Effects of Invention

According to the present invention, it is possible to realize an ion guide that can separate the air current and the ions from each other, and has high ion transmission efficiency.

In addition to the description above, problems, configuration, and effects are clarified by the following description of the embodiments.

DESCRIPTION OF EMBODIMENTS

Hereinafter, the embodiments of the present invention will be described with reference to the drawings.

Example 1

Figure 1:
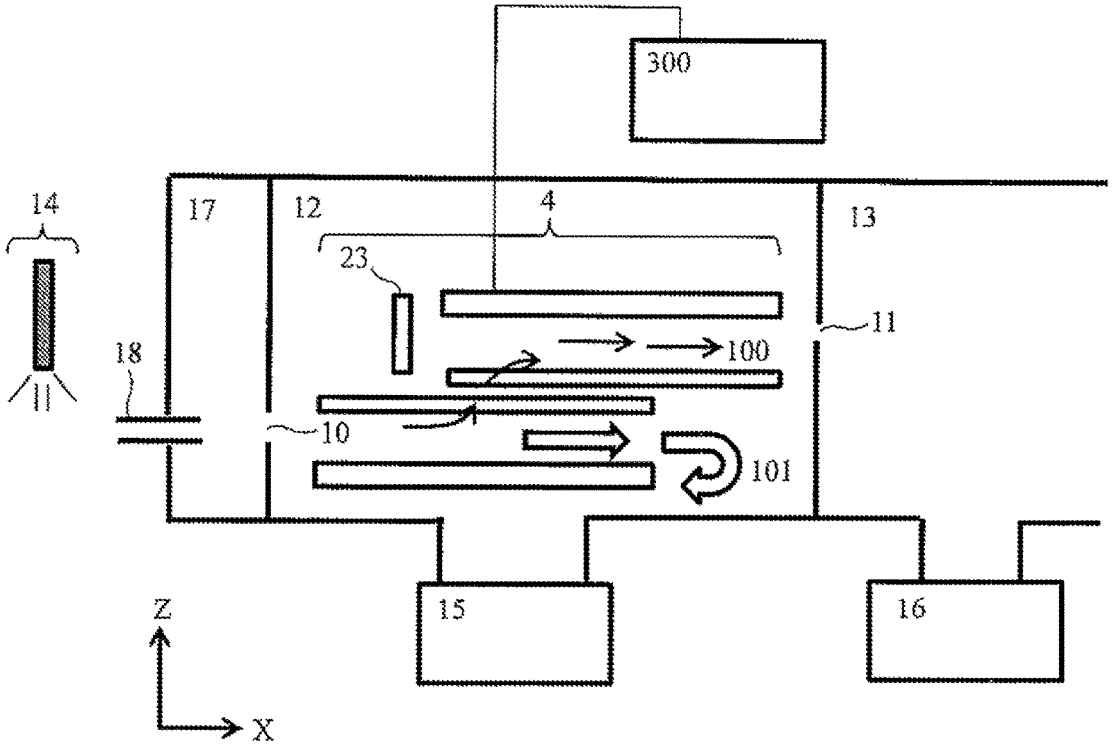
FIG. 1 is a schematic sectional view illustrating a configuration example of a mass spectrometer which uses an ion guide of the present invention.

FIG. 1 is a schematic sectional view illustrating a configuration example of a mass spectrometer which uses an ion guide of the present invention.

Ions which are generated by an ion source 14, such as an electro-spray ion source, an atmospheric pressure chemical ion source, an atmospheric pressure photoion source, and an atmospheric pressure matrix-assisted laser desorbed ion source, are introduced into a vacuum chamber of the mass spectrometer passing through a fine hole 18 together with air current. The ions may be directly introduced into a differential exhaust portion 12 from the fine hole 18, or may be introduced into the differential exhaust portion 12 from a fine hole 10 via an intermediate vacuum chamber 17 as illustrated in FIG. 1. In the differential exhaust portion 12, an ion guide 4 for transporting the ions is installed, and the ions are exhausted by a vacuum pump 15. The voltages are applied from an ion guide power supply 300 to the ion guide 4. As will be described later, ions 100 separated from air current 101 by the ion guide 4 are introduced into a mass spectrometry portion 13 passing through a fine hole 11. The mass spectrometry portion 13 is exhausted by a vacuum pump 16. A pressure at which the ion guide of the example is operated is approximately 10000 Pa to $10^{-3}$ Pa. In particular, at 10000 Pa to 10 Pa, it is possible to efficiently converge the ions since kinetic energy of the ions is cooled by collision with neutral gaseous molecules.

Figure 2:
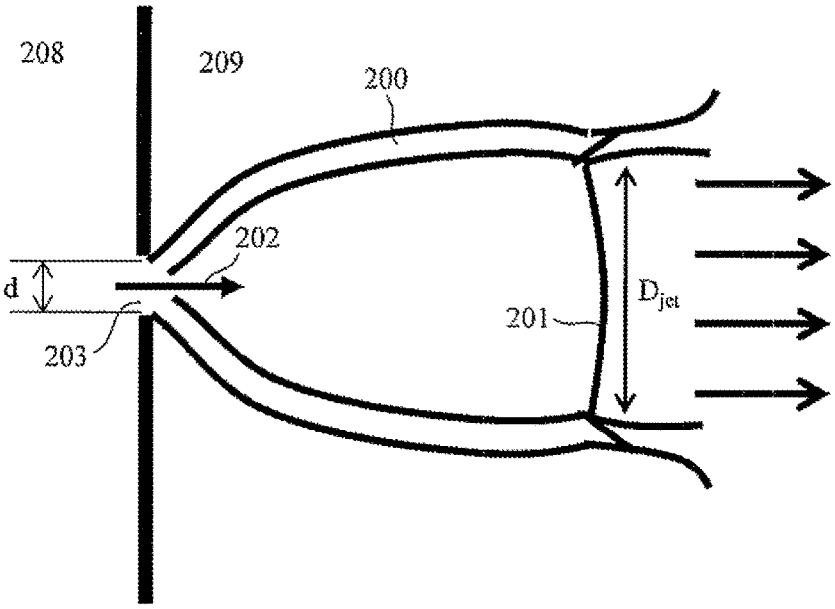
FIG. 2 is a schematic view of air current introduced through a fine hole.

FIG. 2 is a schematic view of the air current introduced into a chamber 209 having a pressure $p_1$ from a chamber 208 having a pressure $p_0$ through a fine hole 203 in a case of a fine hole of which a thickness with respect to a hole diameter d is sufficiently small. As illustrated by arrows in FIG. 2, an incident direction 202 of the air current is a perpendicular direction with respect to a flat surface provided with the fine hole 203. A barrel shock 200 or a Mach Disk 201 is formed in accordance with a pressure difference before and after the fine hole 203, and the air current goes straight with a diameter that is substantially the same as that of the Mach Disk, after the Mach Disk. A diameter $D_{jet}$ of the Mach Disk 201 is given by the following equation.

$$D_{Jet} = 0.412 \times d \times \sqrt{\frac{p_0}{p_1}} \quad \text{[Equation 1]}$$

Figure 3:
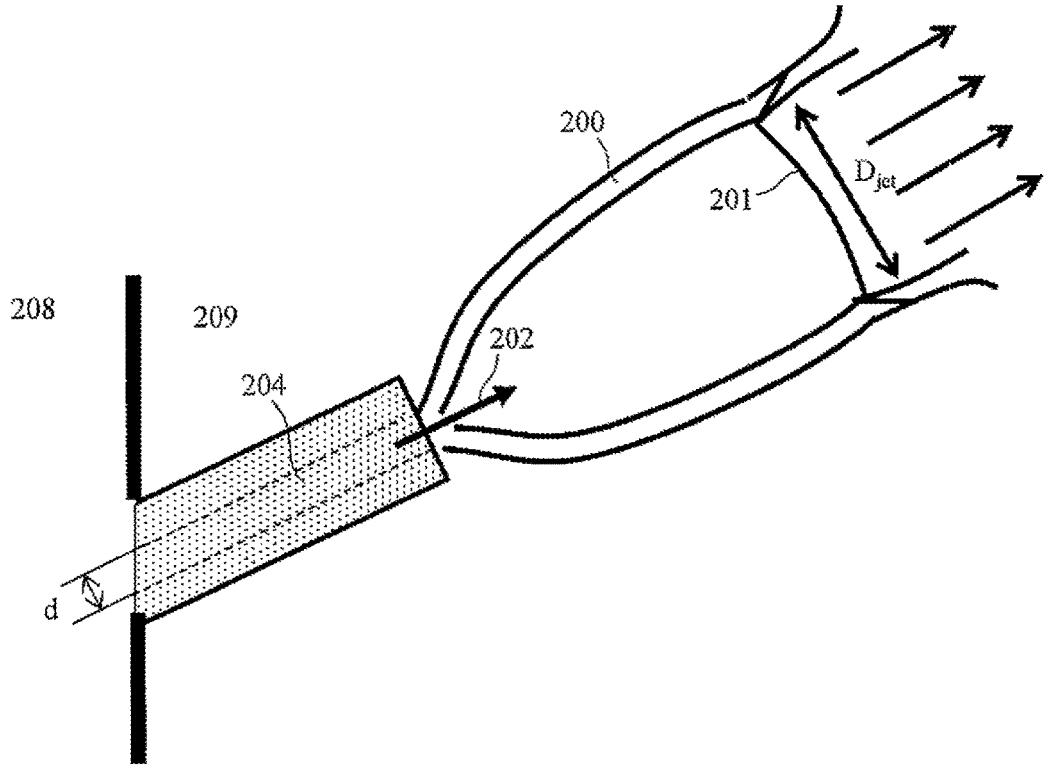
FIG. 3 is a schematic view of the air current introduced through a fine pipe.

FIG. 3 is a schematic view of the air current introduced into the chamber 209 having the pressure $p_1$ from the chamber 208 having the pressure $p_0$ through a fine pipe 204, in a case of a fine pipe of which a thickness with respect to the hole diameter d is sufficiently large. In a case of the fine pipe, the Mach Disk 201 is formed similar to the case of the fine hole, and the air current goes straight with a diameter that is substantially the same as that of the Mach Disk, after the Mach Disk. In a case of the fine pipe, the direction 202 of the air current is a center axis direction of the fine pipe 204.

Figure 4:
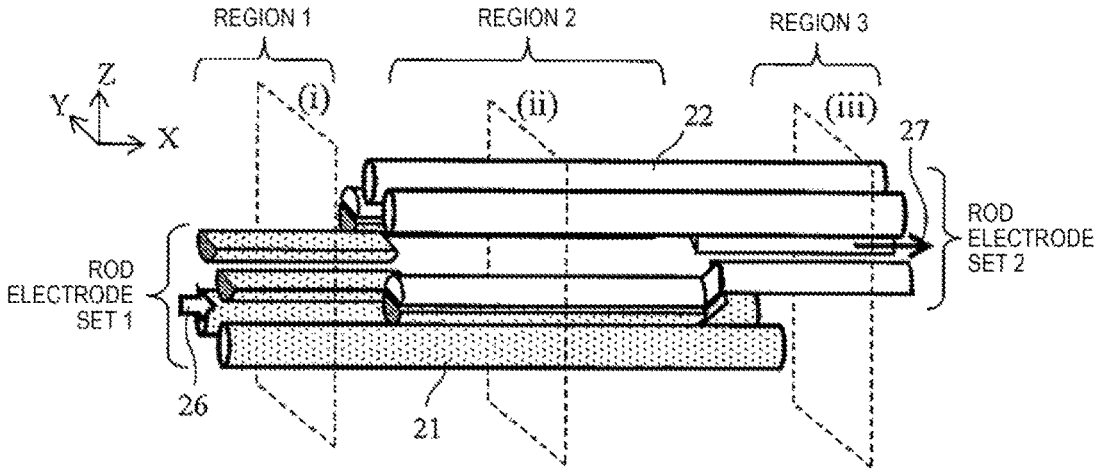
FIG. 4 is a schematic perspective view illustrating the entire ion guide.
Figure 5:
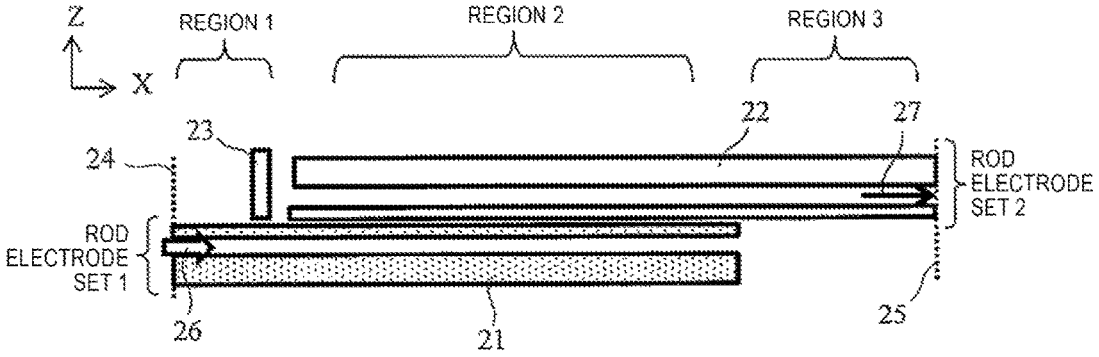
FIG. 5 is a schematic view when the ion guide is viewed in a Y-axis direction.
Figure 6:
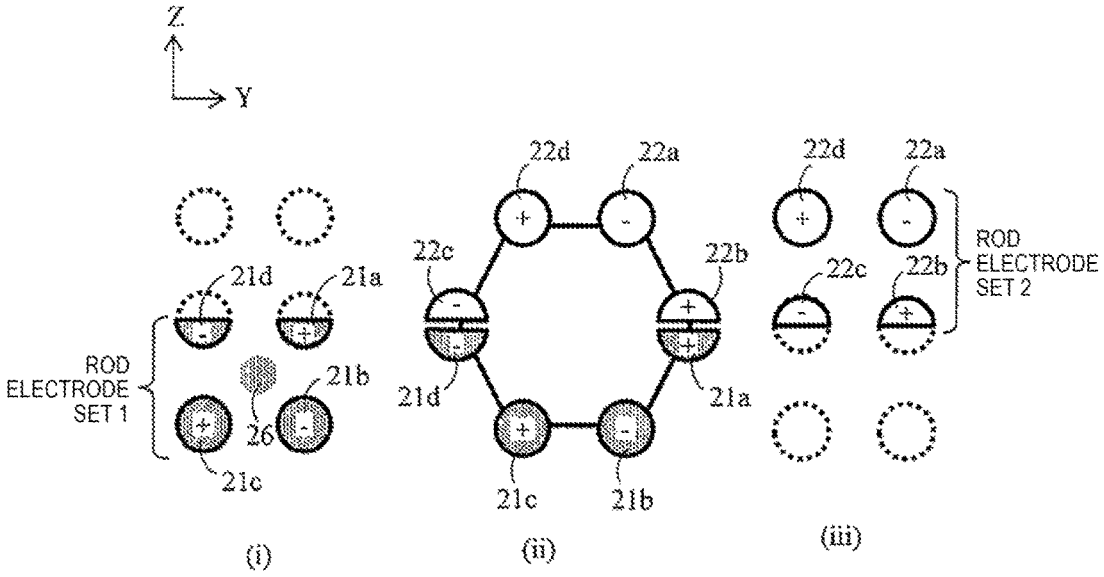
FIG. 6 is a schematic sectional view in a radial direction (YZ plane) of the ion guide.
Figure 7:
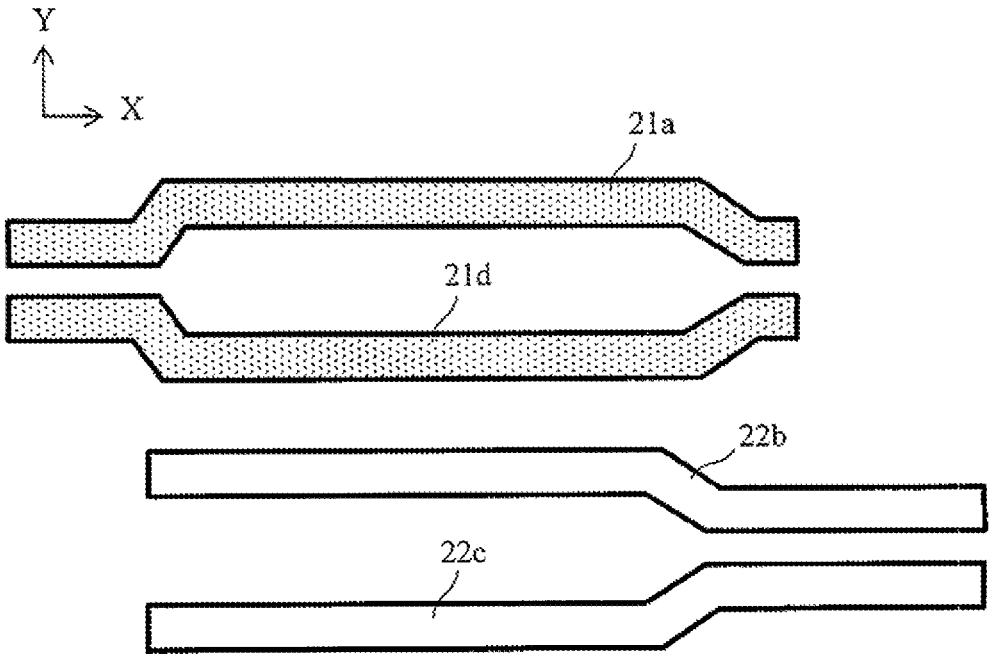
FIG. 7 is a schematic sectional view of a rod electrode.

FIGS. 4 to 7 are schematic views illustrating a configuration example of the ion guide of the example. FIG. 4 is a schematic perspective view illustrating the entire ion guide, FIG. 5 is a schematic view when the ion guide is viewed in a Y-axis direction, FIG. 6 is a schematic sectional view in a radial direction (YZ plane) of positions illustrated by (i), (ii), and (iii) in FIG. 4, and FIG. 7 is a schematic sectional view of an XY plane of a part of rod electrodes 21*a* and 21*d* and rod electrodes 22*b* and 22*c*.

A group 21 of the rod electrodes on a side into which the ions and the air current are introduced is defined as a rod electrode set 1, and a group 22 of rod electrodes on a side from which the ions are discharged is defined as a rod electrode set 2. In the example, the rod electrode set 1 is configured of four rod electrodes 21*a*, 21*b*, 21*c*, and 21*d*, and the rod electrode set 2 is configured of four rod electrodes 22*a*, 22*b*, 22*c*, and 22*d*. In addition, an end on a side into which the ions and air current 26 are introduced in the rod electrode set 1 is defined as an ion guide inlet 24, and an end on a side from which the ions are discharged in the rod electrode set 2 is defined as an ion guide outlet 25. A shape of the rod electrode may be a shape which is close to a column as illustrated in FIG. 4, and may be a shape of a prism or a polygonal. The rod electrodes 21*d*, 22*c*, 21*a*, and 22*b* have a shape, such as a semicircular column to approximate one column or prism by the group of the rod electrodes 21*d* and 22*c* and the group of the rod electrodes 21*a* and 22*b*. Intervals between the rod electrode 21*d* and the rod electrode 22*c*, and between the rod electrode 21*a* and the rod electrode 22*b*, which are adjacent to each other, are approximately 0.1 mm to 2 mm.

A center axis of the rod electrode set 1 and a center axis of the rod electrode set 2 are parallel to each other, but are shifted only by a certain distance in a Z-axis direction. In addition, the rod electrode set 1 and the rod electrode set 2 overlap each other at a part of the region in the longitudinal direction, and in the region where the sets overlap each other, as illustrated in FIG. 6, the rod electrodes of the rod electrode set 1 and the rod electrode set 2 are combined with each other, and a single multipole ion guide is formed.

Symbols "+" and "−" in FIG. 6 indicate a phase of an RF voltage applied to the rod electrode from the ion guide power supply 300. The RF voltages having the same phase, the same amplitude, and the same frequency are applied to the rod electrodes having the same reference numerals. In the same rod electrode set, the RF voltages are applied such that the opposing rod electrodes have the same phase and the adjacent rod electrodes have opposite phases. In addition, the RF voltages having the same phase, the same amplitude, and the same frequency are applied to the rod electrodes 21*d* and 22*c* and the rod electrodes 21*a* and 22*b*, which are adjacent to each other, in different rod electrode sets. In this manner, by applying the voltages, a potential difference of the RF voltage is not generated between the rod electrodes 21*d* and 22*c* of which the interval between the electrodes is narrow and between the rod electrodes 21*a* and 22*b*, and electric discharge can be prevented.

In addition, DC offset voltages are applied to the rod electrode set in addition to the RF voltages. The same offset DC voltages are applied to the rod electrode included in the same rod electrode set. The offset DC voltages are applied such that an electric field that moves the ions of a sample to be measured toward the rod electrode set 2 from the rod electrode set 1, is formed. In other words, in a case of measuring positive ions, the offset DC voltage of which the potential is higher than that of the rod electrode set 2 is applied to the rod electrode set 1, and an offset voltage which is lower than that of the rod electrode set 2 is applied to the rod electrode set 1 in a case of measuring negative ions. When a difference in DC offset of the rod electrode set 1 and the rod electrode set 2 is set to be 0.1 V to 100 V, it is possible to efficiently move the ions to the rod electrode set 2 side from the rod electrode set 1 side.

As illustrated in FIG. 5, an incapacitate electrode 23 is disposed at a final end on the ion guide inlet side of the rod electrode set 2, and here, it is also possible to reduce a loss of ions when applying the DC voltages that push the ions toward the ion guide outlet 25. The voltages applied to the incapacitate electrode 23 are set to be higher than the offset DC voltages applied to the rod electrode set 2 in a case of measuring the positive ions, and are set to be lower than the offset DC voltages applied to the rod electrode set 2 in a case of measuring the negative ions.

Figure 8:
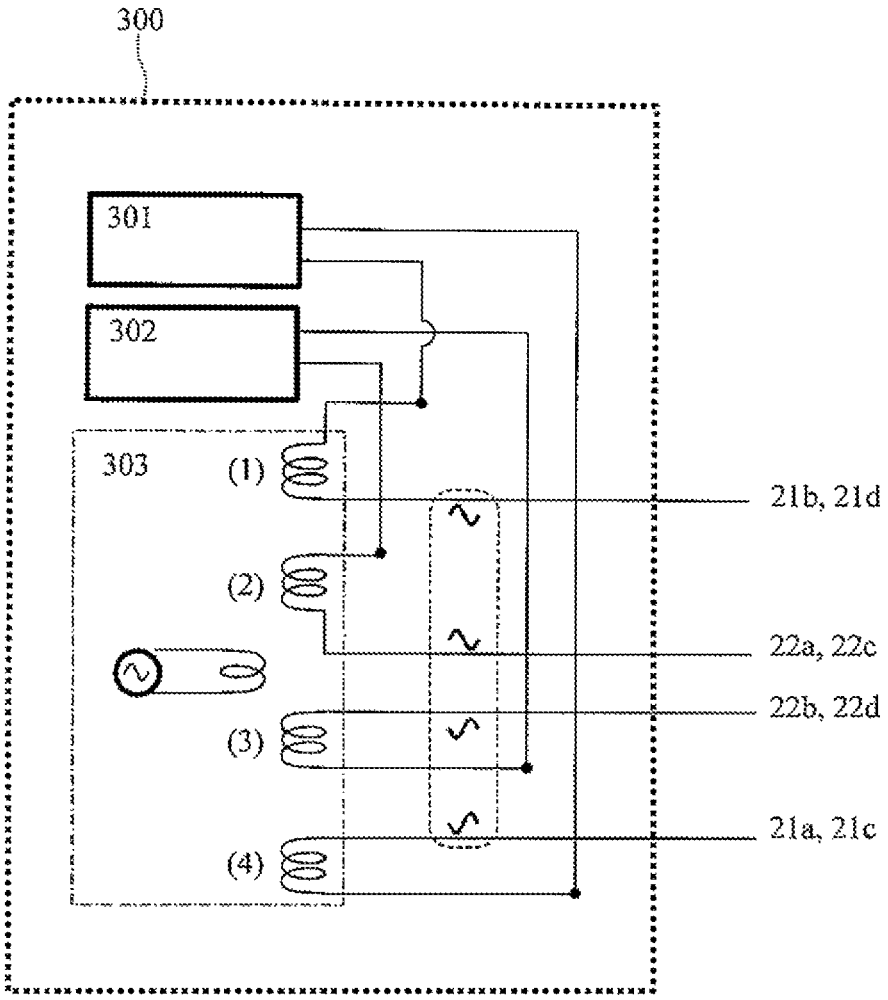
FIG. 8 is a schematic view illustrating an example of an ion guide power supply.

FIG. 8 is a schematic view illustrating an example of the ion guide power supply. The ion guide power supply 300 is configured of a DC power supply 301 which generates the offset voltages of the rod electrode set 1, a DC power supply 302 which generates the offset voltages of the rod electrode set 2, and an RF power supply 303 which generates two-phased RF voltages having phases different from each other by 180 degrees, and applies the offset voltages and the RF voltages to each of the rod electrodes, respectively.

As illustrated in FIGS. 4 and 5, the ion guide of the example is divided into three regions 1 to 3. A positional relationship in the radial direction (YZ plane) of the groups 21 and 22 of the rod electrodes in each of the regions varies, and a pseudopotential formed as a result also varies.

In the region 1, four rod electrodes of the rod electrode set 1 are disposed at a position in the vicinity of a peak of a substantial square, and a quadrupole ion guide is formed. The pseudopotential in the radial direction (YZ plane) is formed by the RF voltages applied to the four rod electrodes of the rod electrode set 1.

The pseudopotential is given by the following equation as the potential which gives a force that acts as a time average on the ions in a case where the electric field that varies at a velocity at which the movement of the ions cannot follow is applied.

$$\Phi' = \frac{Ze}{4m\Omega^2}\bar{E}^2 \qquad \text{[Equation 2]}$$

Here, m is a mass of ions, Z is an ionic valence, e is a quantum of electricity, Ω is a frequency of RF voltages, and E is an electric field.

Figure 9:
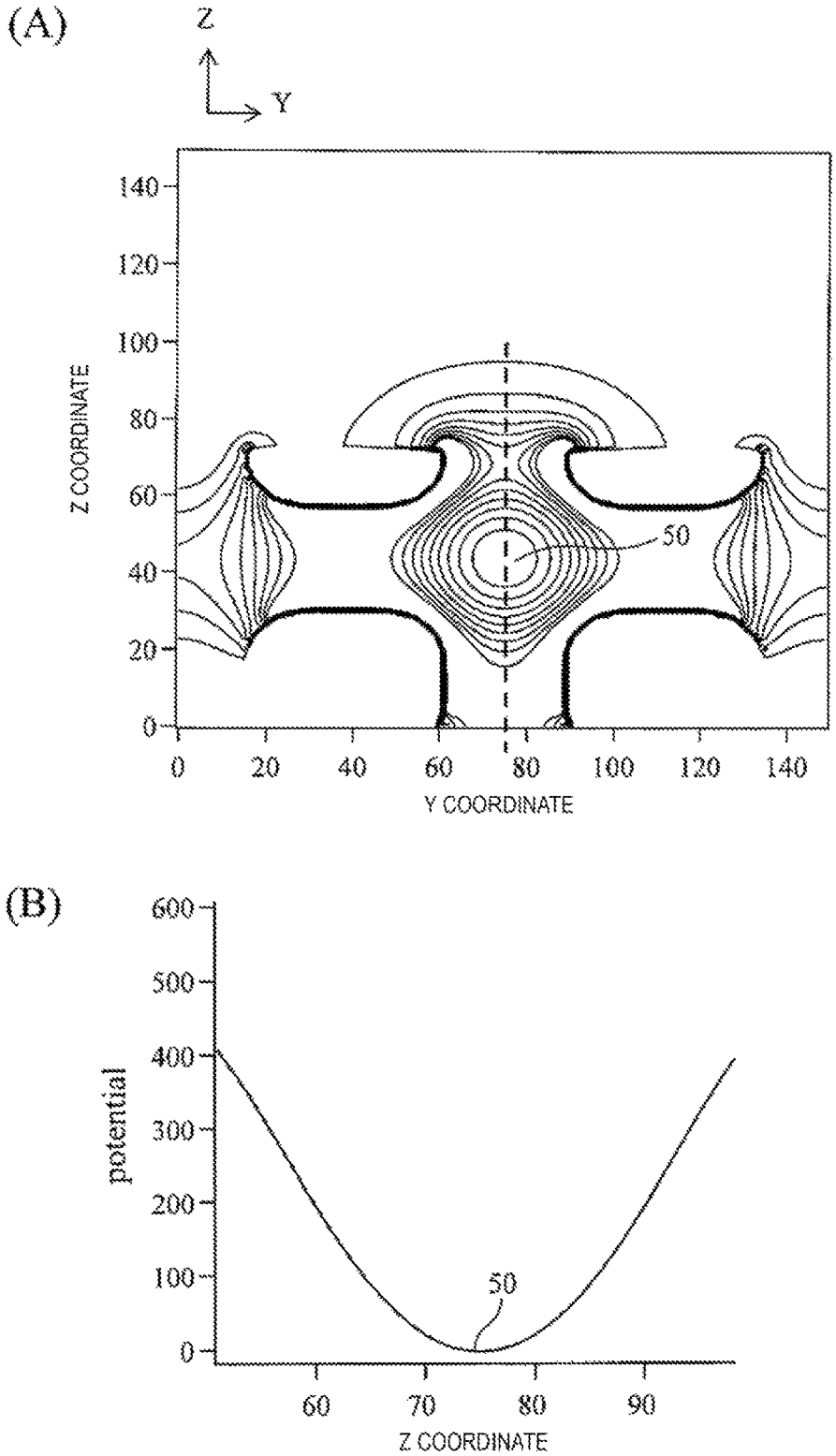
FIG. 9 is a view illustrating a potential generated by the ion guide.

FIG. 9 is a view illustrating the potential generated by the ion guide, and FIG. 9(A) is a view illustrating a pseudopotential in the radial direction (YZ plane) of the region 1. In addition, FIG. 9(B) is a view in which the height of the potential is plotted with respect to the position in the Z direction in the axis illustrated by a wave line in FIG. 9(A). The pseudopotential of the quadrupole is a quadratic function that considers a point at which the electric field formed by the RF voltages is the minimum as a minimum point. The center axis of the ion guide is defined by a line which links minimum points 50 of the pseudopotential in the radial direction (YZ plane) to each other. In the region 1, since a pseudopotential barrier exists between the rod electrode set 1 and the rod electrode set 2, the ions cannot move between the rod electrode sets.

In the region 2, the rod electrode set 1 and the rod electrode set 2 overlap each other. In addition, as illustrated in FIG. 7, the interval of the group of the rod electrodes 21*a* and 22*b* and the group of the rod electrodes 21*d* and 22*c* widens from the position of the region 1 and the region 3, and as illustrated in FIG. 6, a hexapole ion guide in which the group of the rod electrodes 21*a* and 22*b*, the rod electrode 21*b*, the rod electrode 21*c*, the group of the rod electrodes 21*d* and 22*c*, the rod electrode 22*d*, and the rod electrode 22*a* are disposed at the positions of the peaks of a substantial regular hexagon, is formed. Since the RF voltages having the same phase, the same amplitude, and the same frequency are respectively applied to the group of the rod electrodes 21*d* and 22*c* and the group of the rod electrodes 21*a* and 22*b*, when considering the pseudopotential, it is possible to consider each of the group of the rod electrodes 21*a* and 22*b* and the group of the rod electrodes 21*d* and 22*c* as one electrode.

Figure 10:
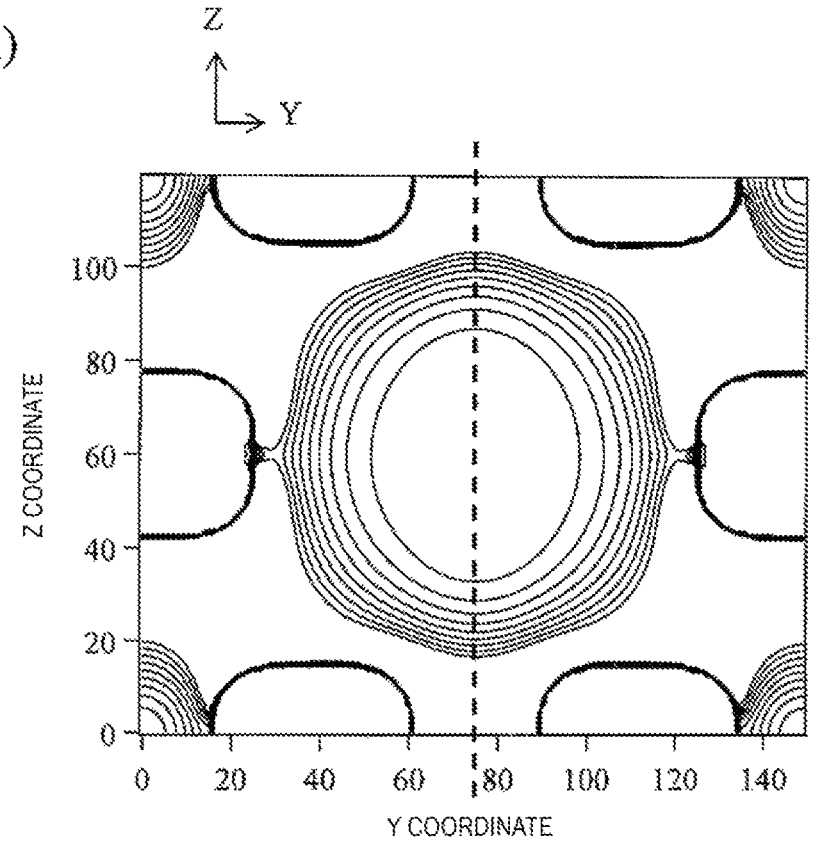
FIG. 10 is a view illustrating the potential generated by the ion guide.
Figure 10:
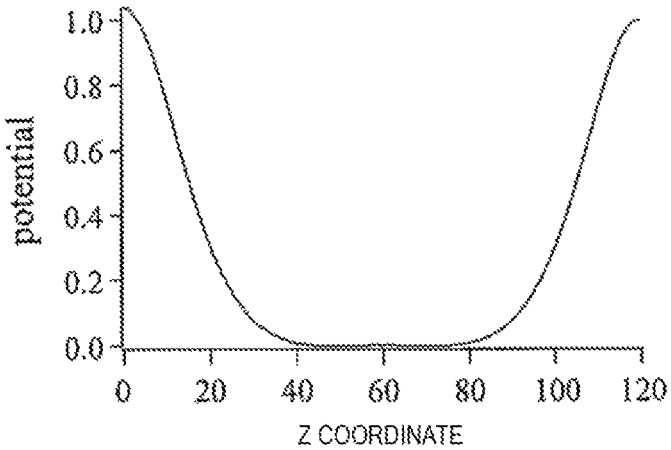

FIG. 10 is a view illustrating the potential generated by the ion guide, and FIG. 10(A) is a view illustrating the pseudopotential in the radial direction (YZ plane) of the region 2. In addition, FIG. 10(B) is a view in which the height of the potential is plotted with respect to the Z coordinate in the axis illustrated by the wave line in FIG. 10(A). By forming the hexapole by combining the rod electrode set 1 and the rod electrode set 2 with each other, the single pseudopotential having the minimum point in the vicinity of the center of the region surrounded by the rod is formed. As can be ascertained from FIG. 10(B), the pseudopotential barrier does not exist between the rod electrode set 1 and the rod electrode set 2, and the ions can freely move.

Figure 11:
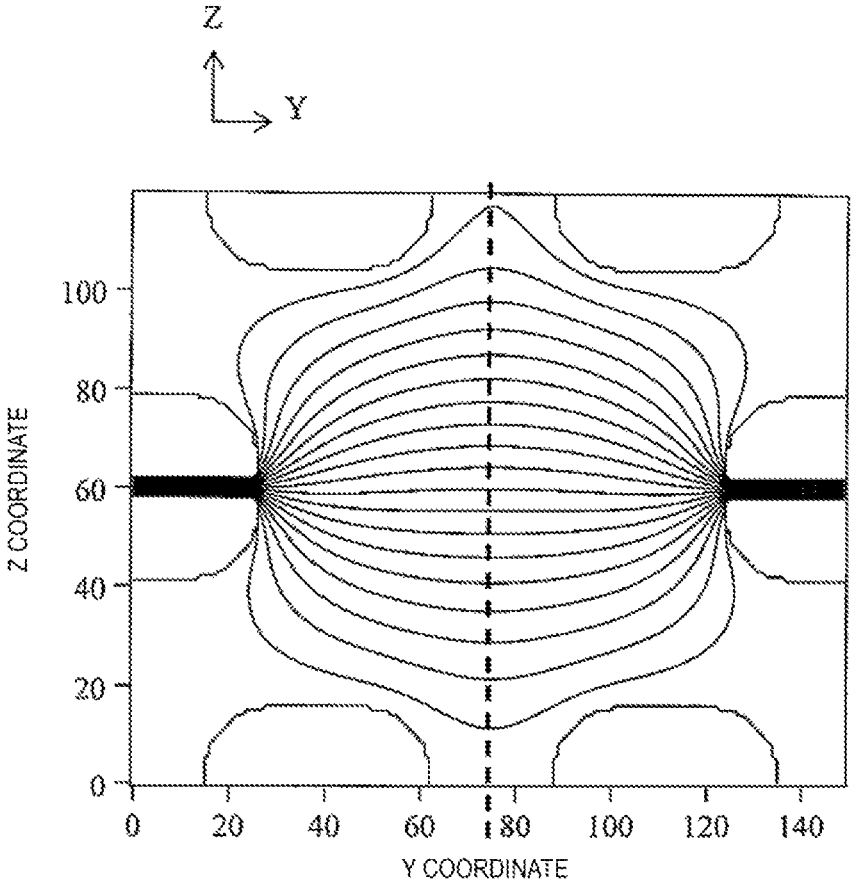
FIG. 11 is a view illustrating the potential generated by the ion guide.
Figure 11:
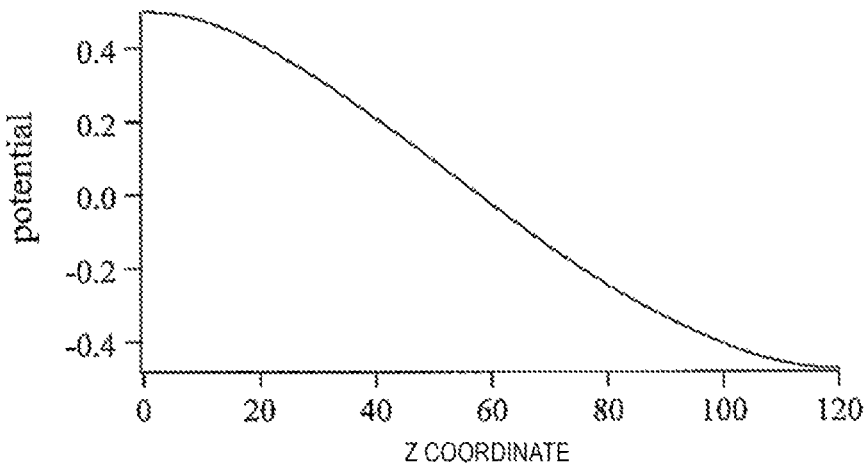

Meanwhile, the DC potential is formed in the radial direction (YZ plane) by the difference in offset DC voltage applied to the rod electrode set 1 and the rod electrode set 2. FIG. 11 is a view illustrating the potential generated by the ion guide, and FIG. 11(A) is a view illustrating the DC potential in the radial direction (YZ plane) of the region 2. In addition, FIG. 11(B) is a view in which the height of the potential is plotted with respect to the position in the Z direction in the axis illustrated by a wave line in FIG. 11(A). By the DC potential, a force which moves the ions in the Z direction (toward the rod electrode set 2 from the rod electrode set 1) acts. In the ion guide of the example, by applying the different offset DC voltages to the rod electrode set 1 and the rod electrode set 2, it is possible to efficiently form the DC potential. Meanwhile, as described in PTL 3, since the DC potential formed by the electrode other than the rod electrode, for example, the electrode inserted into a void in the rod electrode, is blocked by the rod electrode, the DC potential has a small influence on the inside of the ion guide, and particularly, since the potential is disturbed near the rod electrode, the potential also becomes a reason of the loss of ions.

Figure 12:
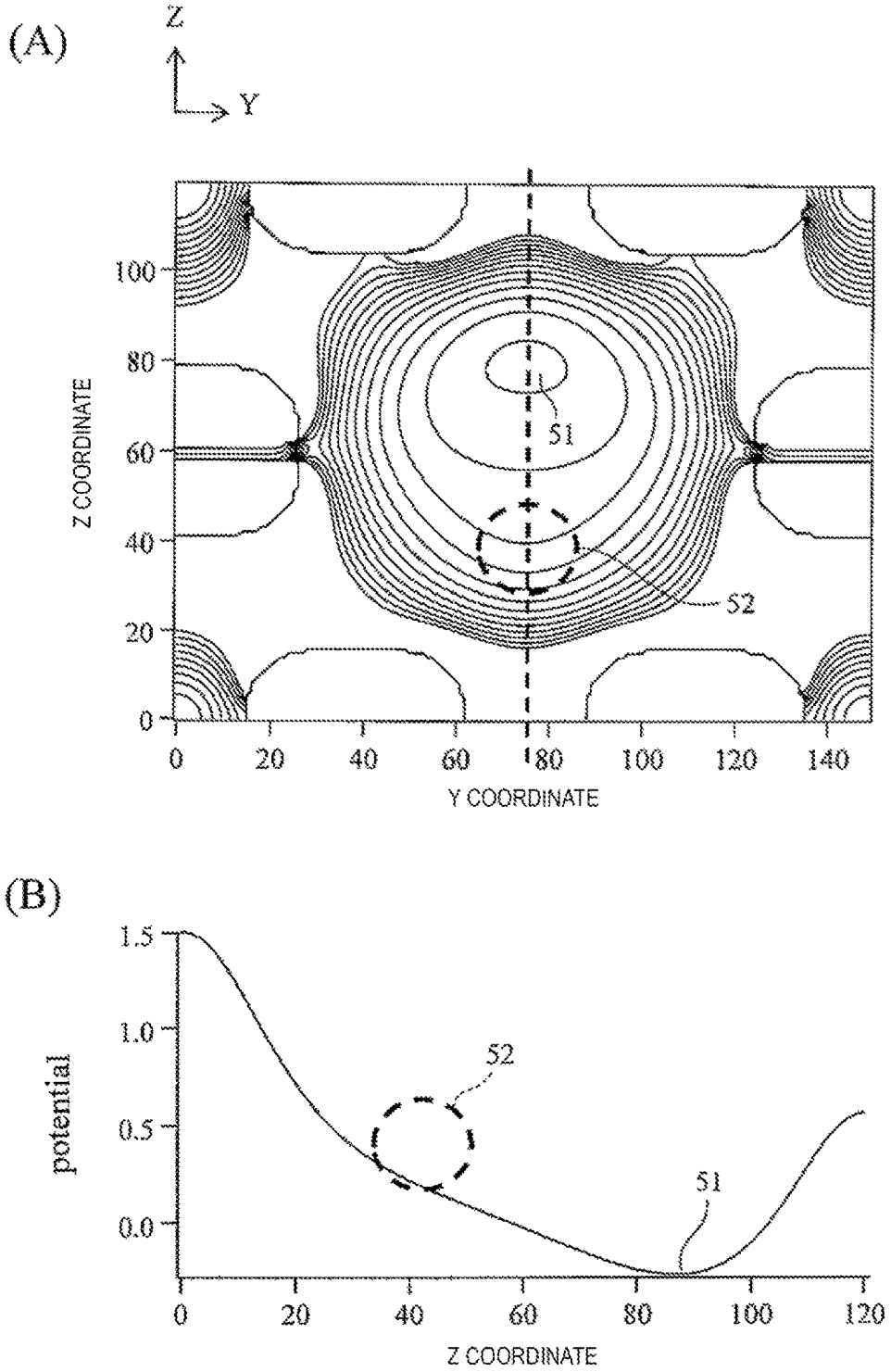
FIG. 12 is a view illustrating a synthetic potential.

FIG. 12 is a view illustrating a synthetic potential in which the pseudopotential and the DC potential are added to each other by the RF voltages. FIG. 12(A) illustrates the synthetic potential in the YZ plane, and FIG. 12(B) illustrates the synthetic potential along the Z axis. A minimum point 51 of the synthetic potential is positioned further on the rod electrode set 2 side than the minimum point of the pseudopotential. In addition, the minimum point 51 of the synthetic potential is positioned further on the rod electrode set 2 side than an incident position 52 of the ions to the region 2 of the ion guide, and acts such that the ions having been guided by the rod electrode set 1 in the region 1 are moved to the rod electrode set 2 side in the region 2.

A connection part between the region 2 and the regions 1 and 3 may be configured to be bent by a gentle angle even in a configuration of being bent by approximately 90 degrees. In a case of being bent by a gentle angle, the potential in the radial direction of the connection part consecutively changes to the potential of a connection tip from the potential of a connection source. In addition, as illustrated in FIGS. 4 and 5, when the rod electrode of the rod electrode set 1 exists to the inlet of the region 3, the electric field in which the ions are moved toward the region 3 from the region 2 exists, and thus, the ions can be efficiently transported to the region 3 from the region 2.

In the region 3, from the position of the region 2, the interval of the group of the rod electrodes 21*a* and 22*b* and the group of the rod electrodes 21*d* and 22*c* narrows, and four rod electrodes of the rod electrode set 2 are disposed at the positions in the vicinity of the peaks of a substantial square. Similar to the region 1, the pseudopotential is formed of four rod electrodes of the rod electrode set 2, and the ions are converged at the center axis of the rod electrode set 2 in the region 3. In a case of the pseudopotential formed of the quadrupole, as illustrated in FIG. 9(B), since inclination of the potential in the vicinity of the minimum point is greater than high-order multipole or ring stack type ion guides, an effect of converging the ions on the axis is high. As the effect of converging the ions increases, the effect that the ions transmit through the fine hole 11 at a rear end of the ion guide increases, and the measurement with high sensitivity becomes possible.

Figure 13:
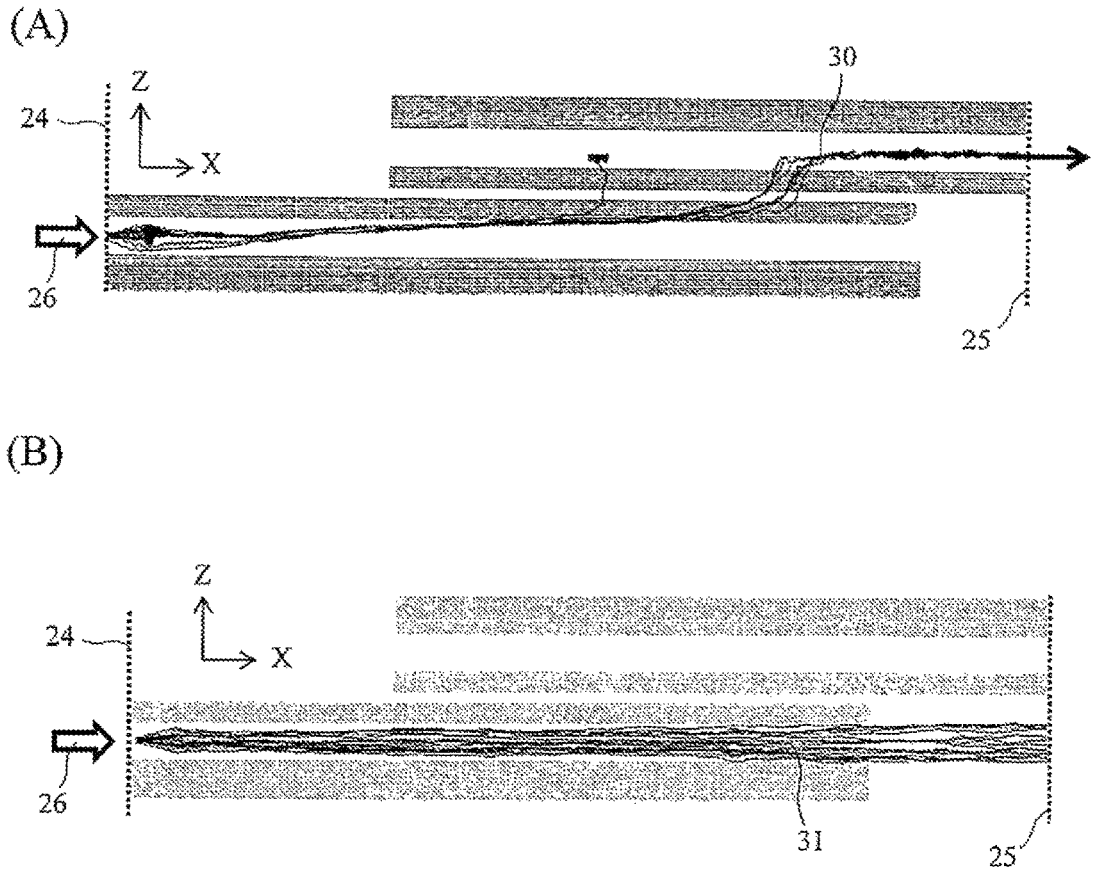
FIG. 13 is a view illustrating a result of ion trajectory simulation in which influence of the air current is considered.
Figure 14:
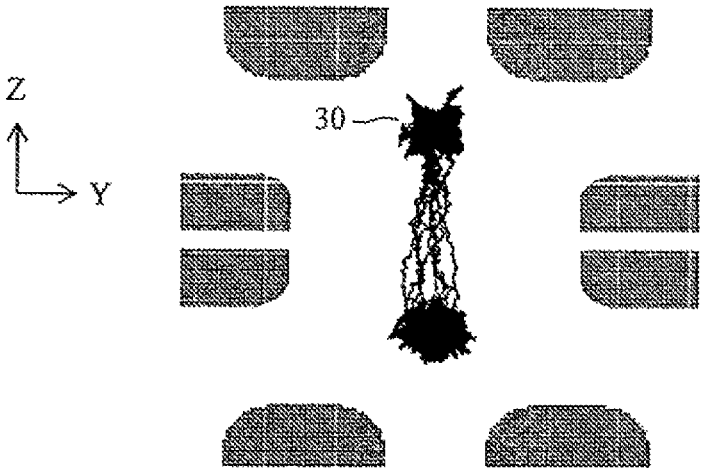
FIG. 14 is a view illustrating a result of ion trajectory simulation in which influence of the air current is considered.
Figure 14:
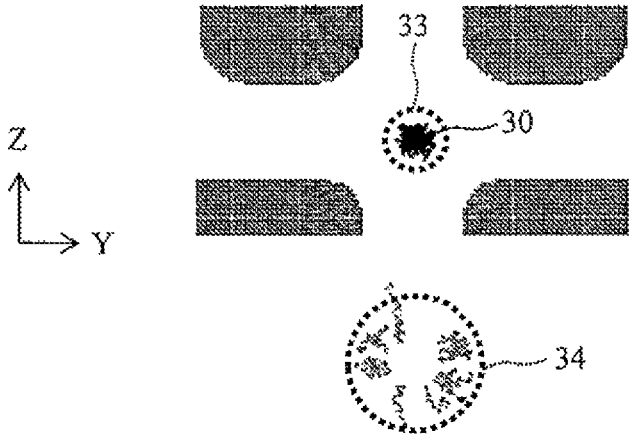

FIGS. 13 and 14 are views illustrating the result of ion trajectory simulation in which the influence of the air current is considered, with respect to the flow of the ions in the ion guide of the example. FIG. 13(A) illustrates a trajectory 30 of the ions when viewed in the Y-axis direction, and FIG. 13(B) illustrates a flow 31 of neutral particles included in the air current when viewed in the Y-axis direction. In addition, FIG. 14(A) illustrates the trajectory of the ions when viewed in the X-axis direction, and FIG. 14(B) illustrates a distribution range of the ions and the neutral particles at the outlet of the ion guide.

The ions are introduced into a differential exhaust portion 12 in which the ion guide 4 is installed through the fine hole or the fine pipe. At the outlet of the fine hole or the fine pipe, the air current illustrated in FIG. 2 or 3 is generated. The ions are introduced to the ion guide 4 along the air current. The air current is substantially coaxially incident to the center axis of the rod electrode set 1 in the region 1. As the ions are coaxially incident to the center axis of the rod electrode set 1 in the region 1, the ions flow to the vicinity of the center axis 50 of the pseudopotential of FIG. 9(A), and the ions can be efficiently introduced to the ion guide 4. In addition, when the Mach Disk of FIG. 2 is generated on the inner side of the pseudopotential of the rod electrode set 1 of FIG. 4, by the force which converges the ions on the center axis of the ion guide, the loss caused by the diffusion in the vicinity of the Mach Disk is suppressed, and the transmission efficiency of the ion guide is improved. The ions are converged on the center axis of the quadrupole ion guide configured of the rod electrode set 1.

The ions move to the region 2 from the region 1 along the air current. As illustrated in FIG. 12, the position 52 at which the ions are incident in the region 2 is in the vicinity of an extending line of the center axis of the quadrupole ion guide configured of the rod electrode set 1 in the region 1. The ions move to the rod electrode set 2 side on which the minimum point 51 of the synthetic potential illustrated in FIG. 12 is present as illustrated in FIGS. 13(A) and 14(A), by the difference in offset DC voltage of the rod electrode set 1 and the rod electrode set 2. When comparing the DC potential and "Equation 2" of the pseudopotential with each other, the DC potential has a greater force given to the ions at the same applied voltages. Therefore, by using the DC potential, it is possible to efficiently take out the ions from the air current even when the applied voltage is low. Meanwhile, since the neutral particles or liquid droplets which are included in the air current are unlikely to receive influence of the electric field, the neutral particles or the liquid droplets go straight as they are in the X-axis direction as illustrated in FIG. 13(B). In this manner, by using the DC potential formed by the difference in offset DC voltage of the rod electrode set 1 and the rod electrode set 2, it is possible to separate the distribution of the neutral particles included in the ions and the air current.

In the region 2, the ions which are moved to the rod electrode set 2 side are introduced into the quadrupole ion guide configured of the rod electrode set 2 of the region 3. In the region 3, since the air current and the ions are separated from each other, there is not an influence on the convergence caused by the diffusion of the ions by the air current and high density of the ions in the air current. Therefore, the ions are likely to be converged on the center axis of the ion guide. When the ions are converged in a narrow range at the outlet of the ion guide, transmittance of the fine hole 11 increases and high sensitivity is obtained.

FIG. 14(B) is a view illustrating distribution 34 of the neutral particles and distribution 33 of the ions which are included in the air current at the outlet 25 of the ion guide. Since the air current is substantially coaxially incident to the center axis in the region 1 of the rod electrode set 1, the neutral particles included in the air current are distributed on the extending line of the center axis of the rod electrode set 1. Meanwhile, the ions are distributed in the vicinity of the center axis of the rod electrode set 2. Therefore, by using the ion guide of the example, it is possible to separate the ions such that the distribution 34 of the neutral particles and the distribution 33 of the ions which are included in the air current at the ion guide outlet 25 do not overlap each other.

Figure 15:
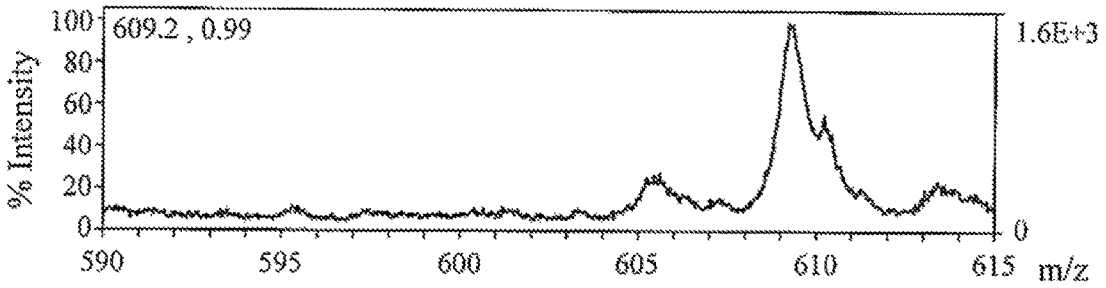
FIG. 15 is a view illustrating a relationship of a mass spectrum of ions, an offset DC voltage, and an ion signal intensity.
Figure 15:
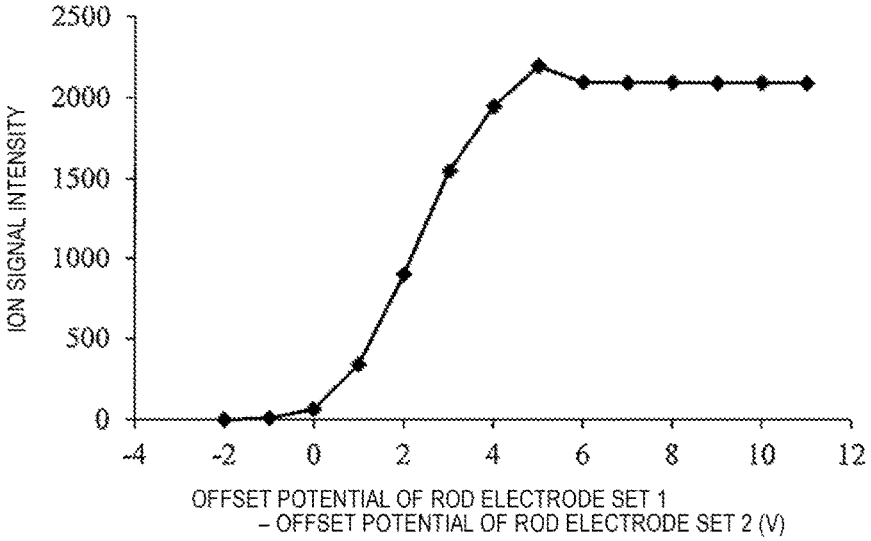

FIG. 15(A) illustrates a mass spectrum of reserpine (m/z=609) measured by using the ion guide of the example. In addition, FIG. 15(B) is a view in which the ion signal intensity of the reserpine is plotted with respect to the difference in offset DC voltage of the rod electrode set 1 and the rod electrode set 2. In a case where the difference in offset DC voltage of the rod electrode set 1 and the rod electrode set 2 is 0 V, the ions are almost not observed. It is considered that this is because the ions go straight along the flow 31 of the air current illustrated in FIG. 13(B). The ion signal intensity gradually increases as the difference in offset DC voltage of the rod electrode set 1 and the rod electrode set 2 increases, and becomes a substantially constant value when the voltage is equal to or greater than 4 V. This illustrates that substantially all of the ions move to the rod electrode set 2 when the offset DC voltage is equal to or greater than 4 V, and are discharged from the center axis of the rod electrode set 2.

By separating the air current and the distribution of the ions by the ion guide of the example, and by introducing the ions to the mass spectrometry portion side by cutting out only the components within the distribution range of the ions, a flow rate of the gas introduced to the mass spectrometry portion side by the ion guide decreases, and the load of the vacuum pump decreases. Accordingly, it is possible to use a vacuum pump which has a low discharge velocity, a small size, and a low price. In addition, the neutral particles included in the air current and the liquid droplets included in the air current are prevented from entering into a path of the ions of the mass spectrometry portion, and robust properties of the device are improved. In particular, since the liquid droplets cause noise, S/N is also improved by preventing the liquid droplets from entering.

Example 2

Figure 16:
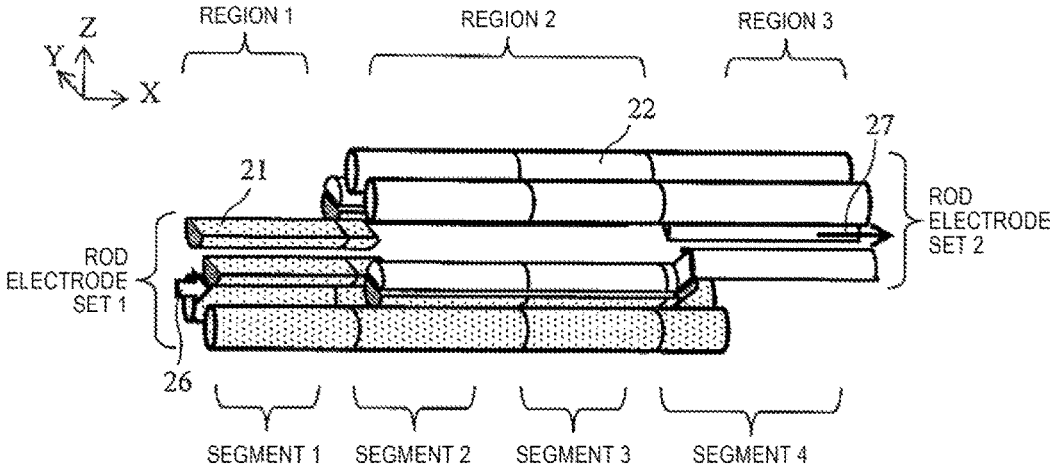
FIG. 16 is a schematic perspective view illustrating the entire ion guide.
Figure 17:
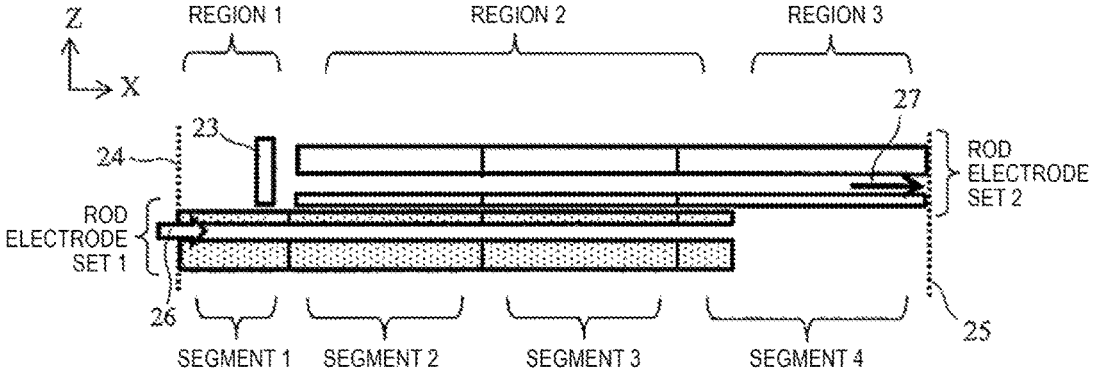
FIG. 17 is a schematic view when the ion guide is viewed in the Y-axis direction.

FIGS. 16 and 17 are configuration views illustrating another example of the ion guide of the present invention. FIG. 16 is a schematic perspective view illustrating the entire ion guide, and FIG. 17 is a schematic view when the ion guide is viewed in the Y-axis direction.

The ion guide of the example is different from that of the example 1 in that the group 21 of the rod electrodes and the group 22 of the rod electrodes are divided into a plurality of segments in the longitudinal direction (X-axis direction) of the ion guide. Each of the rod electrodes of a first rod electrode set and a second rod electrode set is divided into the plurality of segments considering the same position in the longitudinal direction as a division point, and each of the segments is electrically insulated from each other. A method of electric insulation may be a method of providing a void while separating the adjacent segments from each other, or may be a method of interposing the insulating material, such as a segment, between the adjacent segments. In the drawings, an example in which the groups 21 and 22 of the rod electrodes are respectively divided into four segments, is illustrated, but the number of segments may be two or more.

Figure 18:
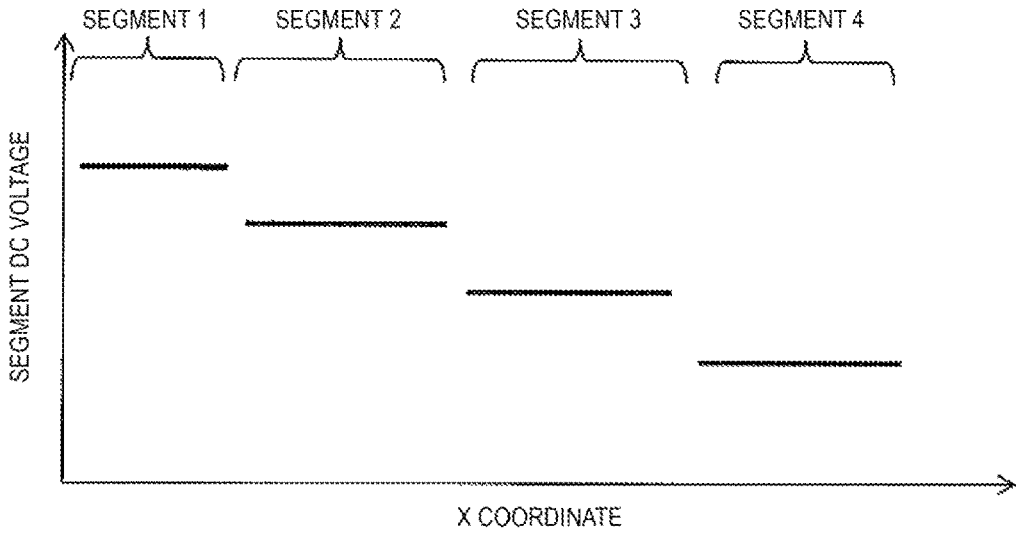
FIG. 18 is a view illustrating an example of a segment DC voltage.

The group 21 of the rod electrodes and the group 22 of the rod electrodes are divided by the YZ plane of the same X coordinate, and only the rod electrode included in the same segment exists on the YZ plane of an arbitrary X coordinate. In addition to the RF voltage and the offset DC voltage, a segment DC voltage is applied independently for each of the segments with respect to the group 21 of the rod electrodes and the group 22 of the rod electrodes. FIG. 18 is a view illustrating an example of the segment DC voltage. The same segment DC voltage is applied to the rod electrode included in the same segment. When the segment DC voltage is set to gradually decrease as approaching the ion guide outlet from the ion guide inlet when measuring the positive ions, the electric field in which the ions are accelerated in the X-axis direction is generated, and the ions can be prevented from remaining on the inside of the ion guide under the condition that the pressure is high.

Figure 19:
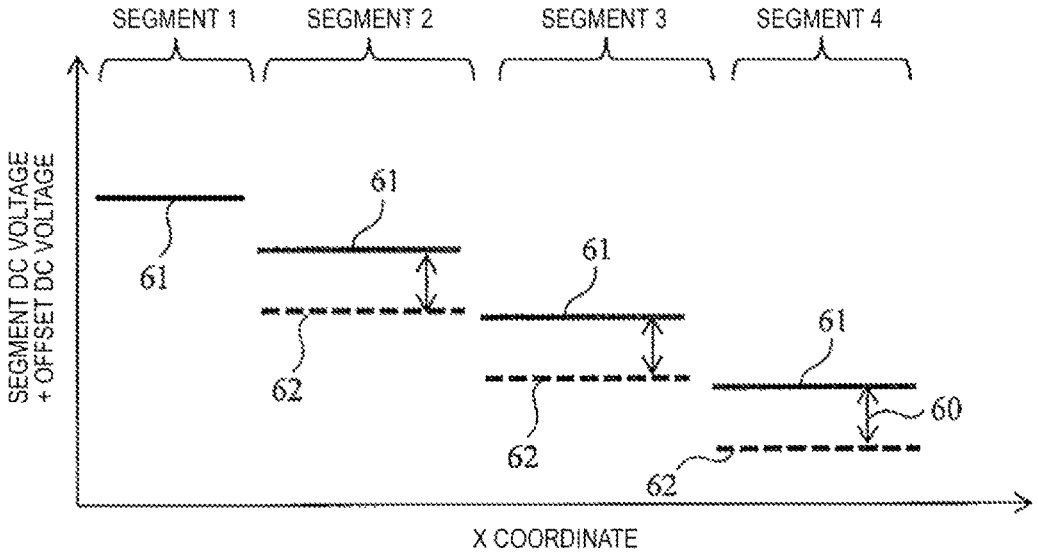
FIG. 19 is a view illustrating a sum of the segment DC voltage and the offset DC voltage.

Meanwhile, the RF voltage and the offset DC voltage are applied similar to the example 1. In other words, the RF voltages having the same phase, the same amplitude, the same frequency are applied in all of the segments with respect to the rod electrode having the same reference numerals as those of FIG. 6. In addition, the same offset DC voltages are applied to the group of the rod electrodes included in the same rod electrode sets. FIG. 19 is a view illustrating a sum of the segment DC voltage and the offset DC voltage. In FIG. 19, 61 indicates the DC voltage applied to each of the segments of the rod electrode set 1, 62 indicates the DC voltage applied to each of the segments of the rod electrode set 2, and 60 indicates a difference in offset DC voltage.

At this time, a relative potential when viewed from the minimum point of the pseudopotential on the YZ plane of each region is the same as that of the example 1. Therefore, similar to the example 1, in the region 1, the ions are converged at the center axis of the rod electrode set 1, in the region 2, the ions are separated from the air current and moved to the rod electrode set 2 side from the rod electrode set 1 side, and in the region 3, the ions on the center axis of the rod electrode set 2 can be converged. In this manner, even in a case where rod electrodes are divided into the segments, it is possible to obtain practically the same functions as those of the example 1. According to this, even in the configuration in which the rod electrodes are divided into the segments in the longitudinal direction (X-axis direction) of the ion guide as described in the example, the electrodes of the segments which are continuous in the longitudinal direction can be collectively defined as one rod electrode.

Example 3

Figure 20:
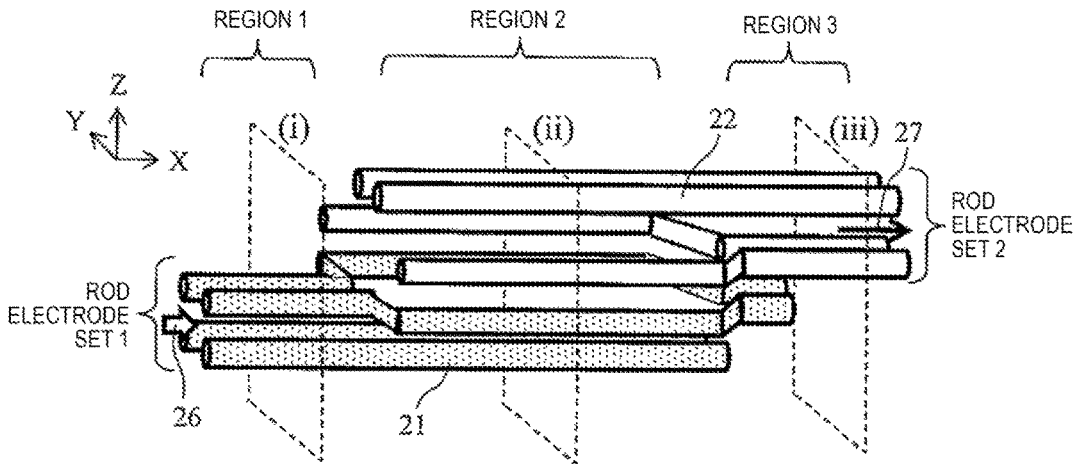
FIG. 20 is a schematic perspective view illustrating the entire ion guide.
Figure 21:
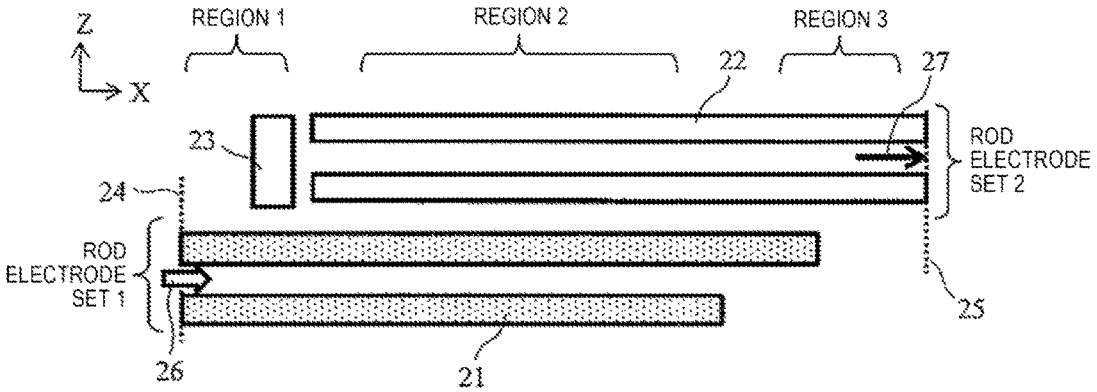
FIG. 21 is a schematic view when the ion guide is viewed in the Y-axis direction.
Figure 22:
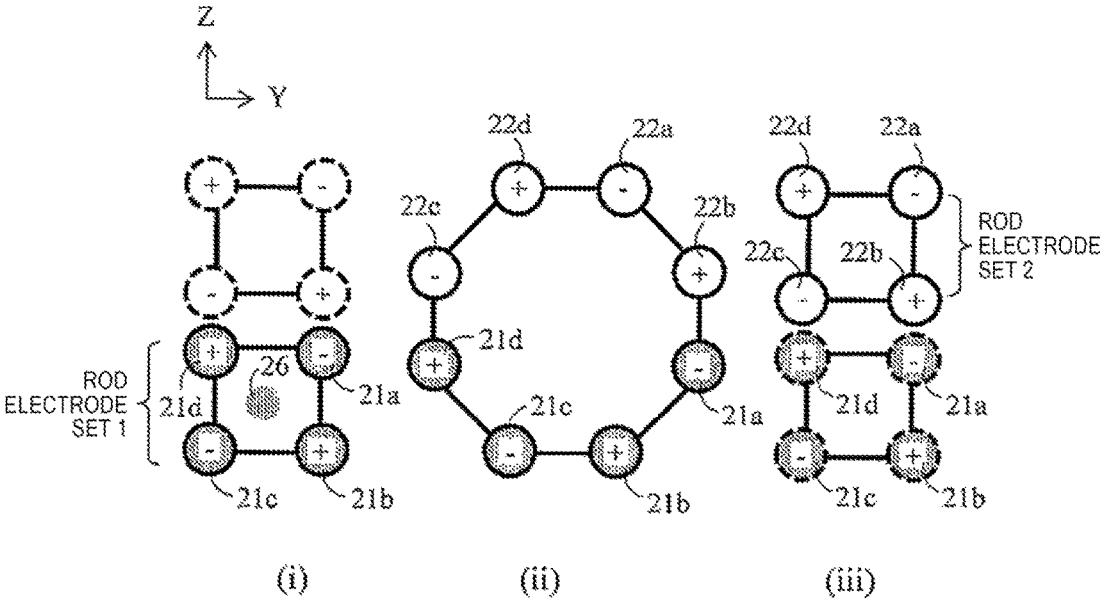
FIG. 22 is a schematic sectional view in the radial direction (YZ plane) of the ion guide.

FIGS. 20 to 22 are configuration views illustrating another example of the ion guide of the present invention. FIG. 20 is a schematic perspective view illustrating the entire ion guide, FIG. 21 is a perspective view when the ion guide is viewed in the Y-axis direction, and FIG. 22 is a sectional view in the radial direction (YZ plane) of the positions illustrated by (i), (ii), and (iii) in FIG. 20. The shape of the rod electrode may be a shape close to a column as illustrated in FIG. 20, and may be a shape of a prism or a polygonal.

The group 21 of the rod electrodes on the side into which the ions and air current are introduced is defined as the rod electrode set 1, and the group 22 of the rod electrodes on the side from which the ions are discharged is defined as the rod electrode set 2. The same offset DC voltage is applied to the rod electrode included in the same rod electrode set. Symbols "+" and "−" in FIG. 22 indicate the phase of the RF voltage, and the RF voltages having the same phase, the same amplitude, and the same frequency, are applied to the rod electrode which are given the same reference numerals.

In the region 1, the quadrupole ion guide is formed of four rod electrodes 21*a*, 21*b*, 21*c*, and 21*d* of the rod electrode set 1. In the region 2, the interval of the rod electrodes 21*a* and 21*d* of the rod electrode set 1 and the rod electrodes 22*b* and 22*c* of the rod electrode set 2 widens from the position of the region 1, and as illustrated in FIG. 22, each of the rod electrodes approaches the positions of the peaks of a substantially regular octagon. By forming the octupole by combining the rod electrode set 1 and the rod electrode set 2 with each other, the single pseudopotential having the minimum point in the vicinity of the center of the region surrounded by the rod is formed. The pseudopotential barrier does not exist between the rod electrode set 1 and the rod electrode set 2, and the ions can freely move. When the offset DC voltage is applied such that the electric field in which the ions of the sample to be measured are moved toward the rod electrode set 2 from the rod electrode set 1 is formed, in the region 2, it is possible to take out the ions from the air current, and to move the ions to the rod electrode set 2 side from the rod electrode set 1 side. The ions which has moved to the rod electrode set 2 side are introduced to the region 3. In the region 3, the quadrupole ion guide is formed of four rod electrodes 22*a*, 22*b*, 22*c*, and 22*d* of the rod electrode set 2, and the ions are converged on the center axis of the quadrupole ion guide. In the example, the octupole is described as an example, but multipole of which the number of poles is more than 8, such as 10, 12, 16, or 20, may be employed.

In the configuration of the example, since it is also possible to use an inexpensive columnar rod electrode of which the processing is easy as the rod electrodes 21*a*, 21*d*, 22*b*, and 22*c*, the price is lower compared to that of the example 1. Meanwhile, in the high-order multipole, such as octupole, a gradient in the vicinity of the center of the pseudopotential is gentle, and thus, the ions are distributed within a wide range in the radial direction, and a loss of ions is likely to be generated in modification locations from the multipole to the quadrupole.

Example 4

Figure 23:
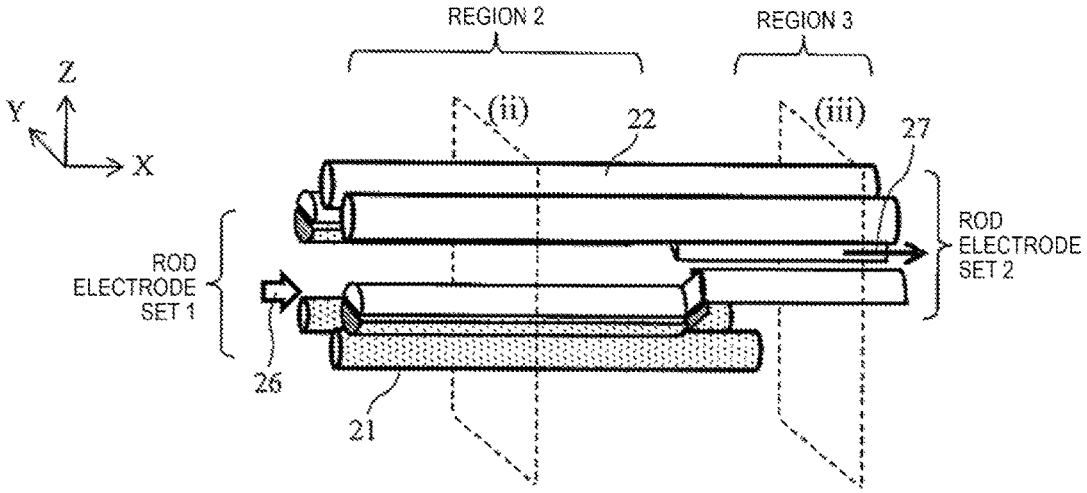
FIG. 23 is a schematic perspective view illustrating the entire ion guide.
Figure 24:
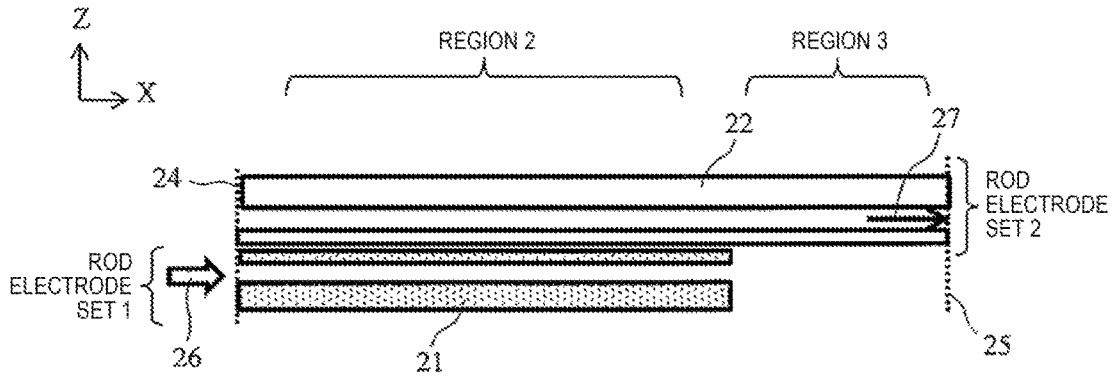
FIG. 24 is a schematic view when the ion guide is viewed in the Y-axis direction.
Figure 25:
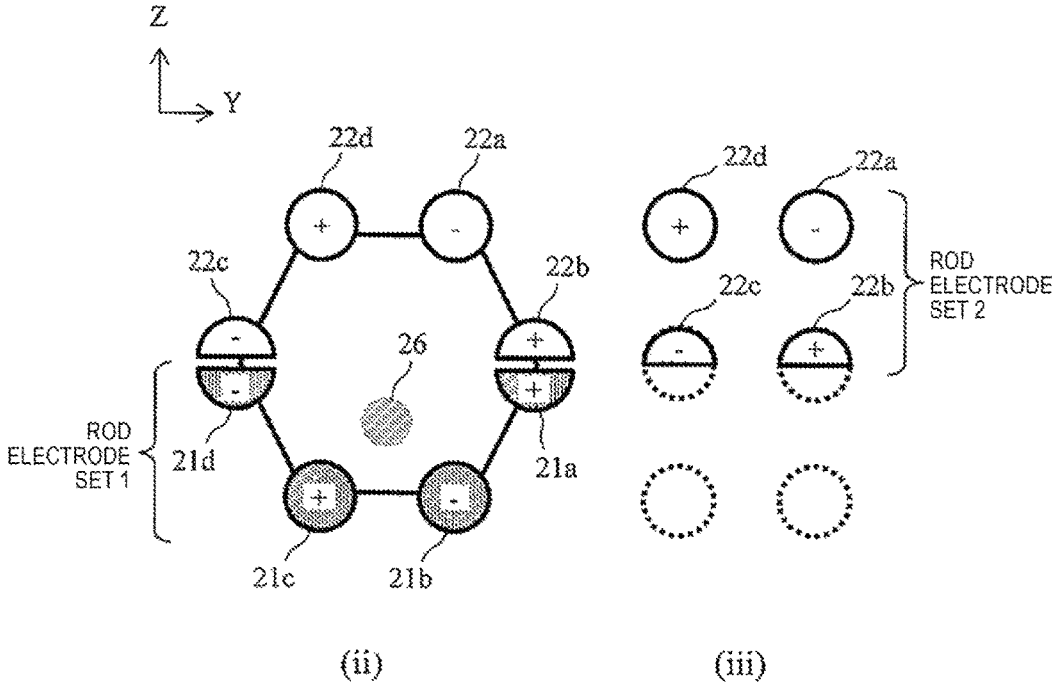
FIG. 25 is a schematic sectional view in the radial direction (YZ plane) of the ion guide.

FIGS. 23 to 25 are configuration views illustrating another example of the ion guide of the present invention. FIG. 23 is a schematic perspective view illustrating the entire ion guide, FIG. 24 is a schematic view when the ion guide is viewed in the Y-axis direction, and FIG. 25 is a sectional view in the radial direction (YZ plane) of the positions illustrated by (ii) and (iii) in FIG. 23.

In the ion guide of the example, there is not a part which corresponds to the region 1 of the example 1, and as illustrated in FIG. 25, the air current 26 including the ions is incident to be parallel to the center axis of the region 2 of the ion guide within the range surrounded by the rod electrodes 21*a*, 21*b*, 21*c*, and 21*d* of the rod electrode set 1 of the region 2. The configuration, the applied voltage, and the behavior of the ions and the air current in the region 2 and the region 3 are similar to those of the example 1.

In the configuration of the example, it is advantageous that the structure is simply inexpensive compared to the configuration of the example 1. Meanwhile, since there is not a part of the region 1 where the ions are converged, the transmission efficiency itself of the ion guide is lower than that of the configuration of the example 1.

In addition, the present invention is not limited to the above-described examples, and includes various modification examples. For example, the above-described examples are described in detail for describing the present invention to make it easy to understand, and the present invention is not necessarily limited to the examples provided with all of the described configurations. In addition, it is possible to switch a part of the configuration of the example into the configuration of another example, and to add a configuration of another example to the configuration of the example. In addition, it is possible to add, remove, and switch other configurations with respect to a part of the configurations of each of the examples.

REFERENCE SIGNS LIST

4 ion guide
10, 11 fine hole
12 differential exhaust portion
13 mass spectrometry portion
14 ion source
17 intermediate vacuum chamber
18 fine hole
21 to 22 rod electrode set
23 incapacitate electrode
24 ion guide inlet
25 ion guide outlet
27 discharge position of ion
30 ion trajectory
33 distribution range of ions
50 center axis of quadrupole ion guide
51 minimum point of synthetic potential
91 distribution of ions
100 ion
101 air current
200 barrel shock
201 mach disk
203 incident direction of air current
204 fine pipe
300 ion guide power supply

The invention claimed is:

1. An ion guide comprising:

a first rod electrode set which has a first center axis, and which is configured to have ions and air current introduced thereto;

a second rod electrode set which has a second center axis at a distance from the first center axis, and which is configured to discharge the ions therefrom; and a power supply configured to respectively apply different offset DC voltages to the first rod electrode set and the second rod electrode set, wherein the first rod electrode set and the second rod electrode set have a region where the sets overlap each other in a longitudinal direction, and form a single multipole ion guide by being combined with each other in the region where the sets overlap each other, wherein the offset DC voltages form a DC potential for moving the ions, having been guided by the first rod electrode set, to the second rod electrode set in the region where the sets overlap each other, wherein a first interval between rod electrodes of the first rod electrode set in the single multipole ion guide becomes wider than a second interval between the rod electrodes of the first rod electrode set into which the ions and the air current are introduced, and wherein a third interval between rod electrodes of the second rod electrode set in the single multipole ion guide becomes wider than a fourth interval between rod electrodes of the second rod electrode set from which the ions are discharged.

2. The ion guide according to claim 1, wherein the first rod electrode set and the second rod electrode set are quadrupoles, and the single multipole ion guide is a hexapole.

3. The ion guide according to claim 1, wherein the first rod electrode set and the second rod electrode set are quadrupoles, and the single multipole ion guide is an octupole.

4. The ion guide according to claim 1, wherein a center of distribution of neutral particles included in the air current and a center of distribution of the ions at an outlet of the ion guide are different.

5. The ion guide according to claim 1,
wherein a difference in the offset DC voltages of the first rod electrode set and the second rod electrode set is 0.1 V to 100 V.

6. The ion guide according to claim 1,
wherein the first rod electrode set and the second rod electrode set are divided into a plurality of segments with respect to a same position in the longitudinal direction as a division point, and in each of the segments, a segment DC voltage which generates an electric field in which the ions are accelerated in an outlet direction is applied from the power supply.

7. A mass spectrometer comprising:
an ion source which generates ions;
a mass spectrometry portion which performs mass spectrometry with respect to the ions;
an ion guide which transports the ions generated by the ion source to the mass spectrometry portion; and
the ion guide according to claim 1 as the ion guide.

8. An ion guide comprising:
a first rod electrode set which has a first center axis, and which is configured to have ions and air current introduced thereto;
a second rod electrode set which has a second center axis at a distance from the first center axis, and which is configured to discharge the ions therefrom; and
a power supply configured to respectively apply different offset DC voltages to the first rod electrode set and the second rod electrode set,
wherein the first rod electrode set and the second rod electrode set have a region where the sets overlap each other in a longitudinal direction, and form a single multipole ion guide by being combined with each other in the region where the sets overlap each other,
wherein the offset DC voltages form a DC potential for moving the ions, having been guided by the first rod electrode set, to the second rod electrode set in the region where the sets overlap each other, and
wherein the first rod electrode set and the second rod electrode set are quadrupoles, and the single multipole ion guide is a hexapole.

9. The ion guide according to claim 8,
wherein a center of distribution of neutral particles included in the air current and a center of distribution of the ions at an outlet of the ion guide are different,
wherein a first interval between rod electrodes of the first rod electrode set in the single multipole ion guide becomes wider than a second interval between the rod electrodes of the first rod electrode set into which the ions and the air current are introduced, and
wherein a third interval between rod electrodes of the second rod electrode set in the single multipole ion guide becomes wider than a fourth interval between rod electrodes of the second rod electrode set from which the ions are discharged.

10. The ion guide according to claim 8,
wherein a difference in the offset DC voltages of the first rod electrode set and the second rod electrode set is 0.1 V to 100 V.

11. The ion guide according to claim 8,
wherein the first rod electrode set and the second rod electrode set are divided into a plurality of segments with respect to a same position in the longitudinal direction as a division point, and in each of the segments, a segment DC voltage which generates an electric field in which the ions are accelerated in an outlet direction is applied from the power supply.

12. A mass spectrometer comprising:
an ion source which generates ions;
a mass spectrometry portion which performs mass spectrometry with respect to the ions;
an ion guide which transports the ions generated by the ion source to the mass spectrometry portion; and
the ion guide according to claim 8 as the ion guide.

13. An ion guide comprising:
a first rod electrode set which has a first center axis, and which is configured to have ions and air current introduced thereto;
a second rod electrode set which has a second center axis at a distance from the first center axis, and which is configured to discharge the ions therefrom; and
a power supply configured to respectively apply different offset DC voltages to the first rod electrode set and the second rod electrode set,
wherein the first rod electrode set and the second rod electrode set have a region where the sets overlap each other in the longitudinal direction, and form a single multipole ion guide by being combined with each other in the region where the sets overlap each other,
wherein the offset DC voltages form a DC potential for moving the ions, having been guided by the first rod electrode set, to the second rod electrode set in the region where the sets overlap each other, and
wherein the first rod electrode set and the second rod electrode set are quadrupoles, and the single multipole ion guide is an octupole.

14. The ion guide according to claim 13,
wherein the center of distribution of neutral particles included in the air current and the center of distribution of ions are different at an outlet of the ion guide,
wherein a first interval between rod electrodes of the first rod electrode set in the single multipole ion guide becomes wider than a second interval between the rod electrodes of the first rod electrode set into which the ions and the air current are introduced, and
wherein a third interval between rod electrodes of the second rod electrode set in the single multipole ion guide becomes wider than a fourth interval between rod electrodes of the second rod electrode set from which the ions are discharged.

15. The ion guide according to claim 13,
wherein a difference in the offset DC voltages of the first rod electrode set and the second rod electrode set is 0.1 V to 100 V.

16. The ion guide according to claim 13,
wherein the first rod electrode set and the second rod electrode set are divided into a plurality of segments considering the same position in the longitudinal direction as a division point, and in each of the segments, a segment DC voltage which generates an electric field in which the ions are accelerated in an outlet direction is applied from the power supply.

17. A mass spectrometer comprising:
an ion source which generates ions;
a mass spectrometry portion which performs mass spectrometry with respect to the ions;
an ion guide which transports the ions generated by the ion source to the mass spectrometry portion; and
the ion guide according to claim 13 as the ion guide.

18. An ion guide comprising:
a first rod electrode set which has a first center axis, and which is configured to have ions and air current introduced thereto;

a second rod electrode set which has a second center axis at a distance from the first center axis, and which is configured to discharge the ions therefrom; and a power supply configured to respectively apply different offset DC voltages to the first rod electrode set and the second rod electrode set, wherein the first rod electrode set and the second rod electrode set have a region where the sets overlap each other in a longitudinal direction, and form a single multipole ion guide by being combined with each other in the region where the sets overlap each other, wherein the offset DC voltages form a DC potential for moving the ions, having been guided by the first rod electrode set, to the second rod electrode set in the region where the sets overlap each other, and wherein a first interval between rod electrodes of the second rod electrode set in the single multipole ion guide becomes wider than a second interval between rod electrodes of the second rod electrode set from which the ions are discharged.

* * * * *